United States Patent [19]

Sickler

[11] 4,452,336

[45] Jun. 5, 1984

[54] STUD GRIPPER AND ACCESSORIES

[76] Inventor: Jack R. Sickler, P.O. Box 20803, Billings, Mont. 59104

[21] Appl. No.: 187,461

[22] Filed: Sep. 15, 1980

[51] Int. Cl.[3] ..... E04G 3/14; E04G 5/06

[52] U.S. Cl. ..... 182/82; 248/235; 248/216.1; 248/231.5

[58] Field of Search ..... 248/218.4, 225.3, 226.2, 248/235, 245, 216.1, 217.2, 354 C, 354 R; 52/713, 714; 182/82, 178, 179; 403/232.1

[56] References Cited

U.S. PATENT DOCUMENTS

| | | | |
|---|---|---|---|
| 2,345,970 | 4/1944 | Hamel | 248/245 |
| 2,602,620 | 7/1952 | Patton | 248/235 |
| 3,119,590 | 1/1964 | Eriksson | 182/82 |
| 3,158,225 | 11/1964 | Almgren | 248/235 |
| 3,493,208 | 2/1970 | Sato | 248/235 |
| 3,887,036 | 6/1975 | Telban | 182/226 |

FOREIGN PATENT DOCUMENTS

| | | | |
|---|---|---|---|
| 2105393 | 4/1972 | France | 182/82 |

OTHER PUBLICATIONS

Teco Products, p. 6, Jun. 1972.

*Primary Examiner*—R. P. Machado

[57] ABSTRACT

This invention is directed to mechanical staging for use in the construction of a building.

Normally, in the construction of a frame building, there is used staging and which staging is made from wood. This invention is directed to the use of mechanical supports for wooden cants and wooden planks.

There is a stud gripper. The stud gripper can be placed on studs in a wall and a cant supported on the stud gripper. With two spaced apart walls and having stud grippers for supporting cants it is possible to place planks on the cants. A workman can stand on the planks and be supported for further work in the building.

In conjunction with the stud gripper there can be used an adapter bracket. The adapter bracket is supported on the stud gripper. Cants can be supported on the adapter bracket. With spaced apart walls it is possible to have stud grippers and adapter brackets on the studs of the walls and to run cants between the stud grippers and the adapter brackets. Then, support planks can be placed on the cants and workmen can stand on the planks for further work in the frame building.

Utility brackets can be supported by the stud gripper.

In a wall two spaced apart stud grippers and utility brackets can be supported on the studs. Support planks can be placed on the utility brackets and run along the walls. A workman can stand on the planks and work on the frame building.

37 Claims, 23 Drawing Figures

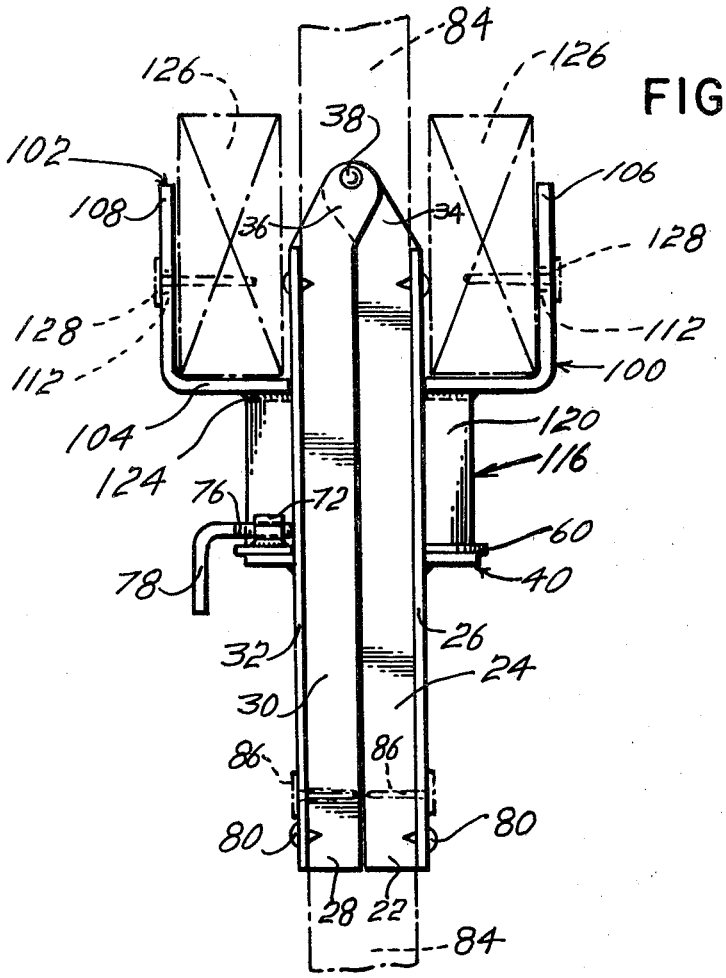
FIG. 10
FIG. 11
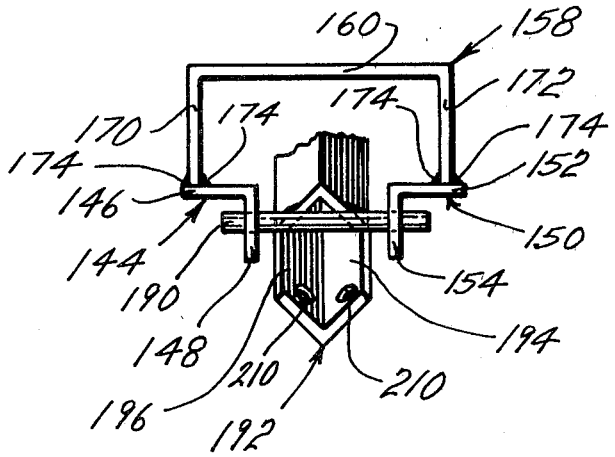

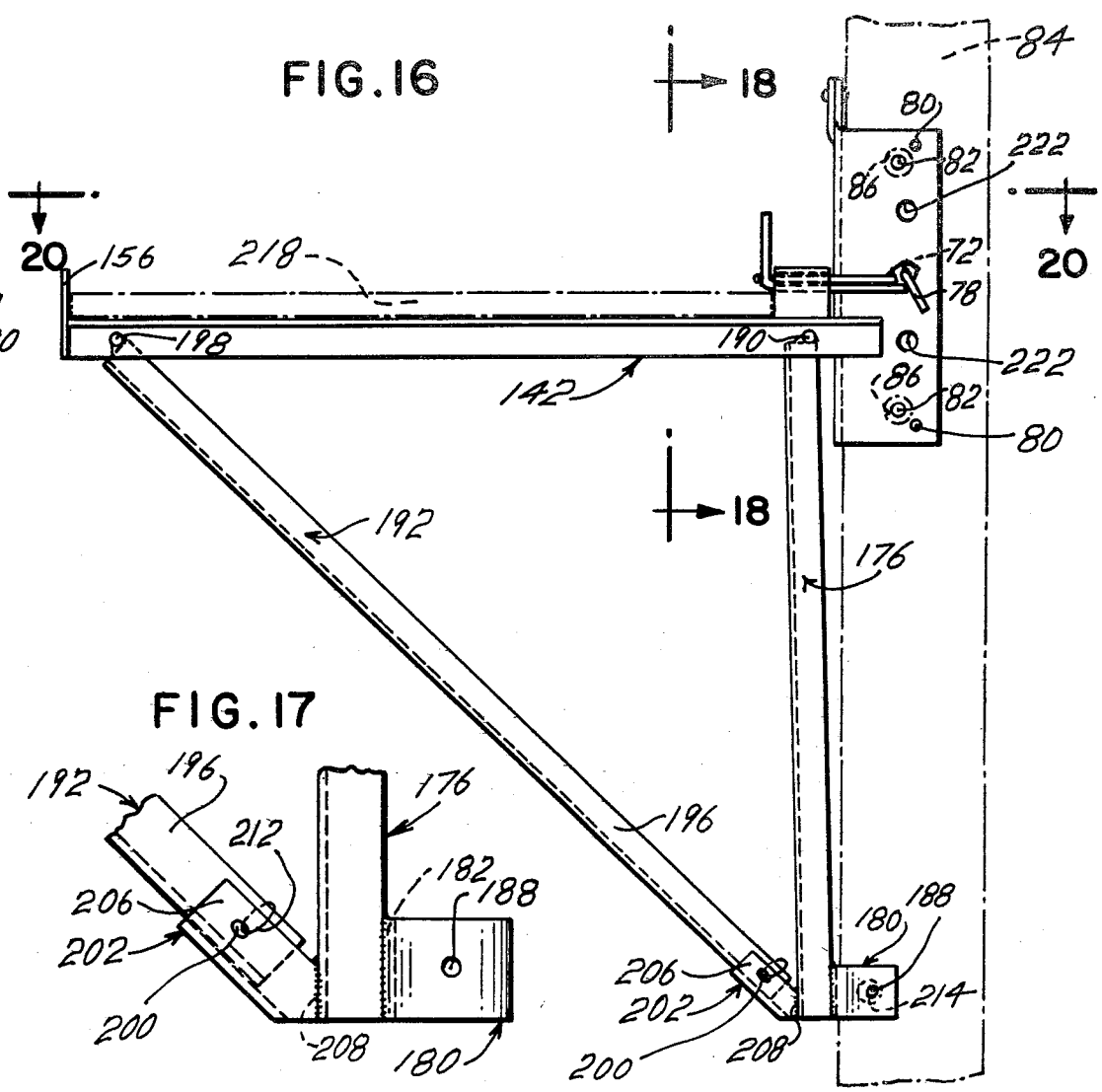
FIG. 16
FIG. 17
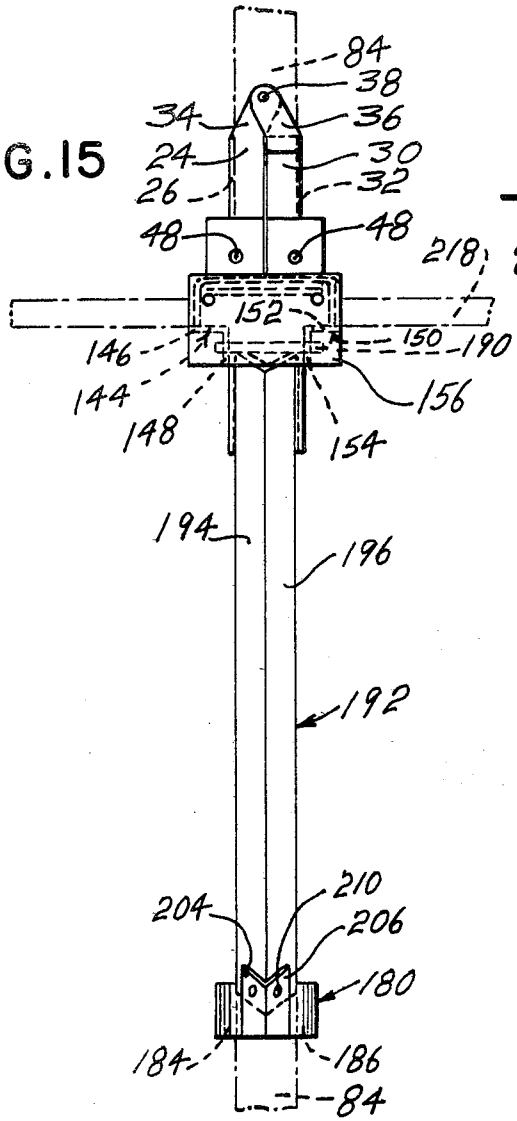
FIG. 15

STUD GRIPPER AND ACCESSORIES

BACKGROUND OF THE INVENTION

In the construction of a frame building there are exposed studs. These studs are in a set and may define an outside wall or an inside wall.

In the course of the construction of the building exposed studs are not covered so as to allow electrical wiring, plumbing and additional carpentry to be completed. Then, the exposed studs will be covered with a finished material. A normal finish material is sheet rock or wall board. It is also possible to cover the exposed studs with wood or other appropriate building materials such as plaster. In order to apply wall board to the ceiling of a room there may be used wooden staging. The wooden staging is constructed so that the workmen can stand on the wooden staging and lift the wall board to the ceiling. Then, the wall board can be attached to the rafters or the wooden trusses. The building of the wooden staging is time consuming. For example, it is necessary to erect the wooden staging and then after the staging has served its purpose, it is necessary to take down the wooden staging. The wooden staging is normally used, one time, in the construction of a building. Naturally, in order to construct the wooden staging, there is required wood. Wood is expensive. Also, it is expensive to erect the wooden staging and expensive to take down the wooden staging. To erect the wooden staging, it is necessary to carry the wood into the building. After the wooden staging has been taken down, it is necessary to carry the wood away from the building.

I have invented a stud gripper and accessories which is a mechanical staging. It is possible to, quickly, clamp the stud gripper onto the studs. Then, the stud gripper can be used for staging. After the stud gripper and accessories have served their purpose it is possible to quickly remove them from the studs in a wall. Also, it is possible to use the stud gripper and accessories many times, as contrasted with wood, one time. The stud gripper is more versatile than wood as it is possible to have the stud gripper position and hold a cant parallel to the studs in a wall or at an angle to the studs in the wall. With my stud gripper and accessories less wood is used as the wood is not used in the staging and also the stud gripper is less expensive to use as less wood is used.

In the start of a first wall there is a first set of spaced-apart studs. With my stud gripper and accessories it is possible to position a plank next to the studs in the first set of spaced apart studs. The cant may be a two-by-four or may be a plank. Also, it is possible to support a piece of sheet rock or piece of wall board in the placing of the wall board in the ceiling.

Also, with my equipment, it is possible to run cants between a second set of spaced-apart studs in a second wall and the first set of spaced-apart studs in the first wall. On top of the cants there can be placed a plank or planks so that workmen can stand on these planks and place wall board on the ceiling.

Further, in addition to the placing of the wall board on the ceiling the workmen can stand on the planks and position electrical wiring overhead and also position electrical outlets overhead.

Likewise, the workmen can position plumbing overhead, when there are plumbing facilities on a second floor or an upper floor, and can save time because of the ability to walk on planks near the ceiling-to-be of a room.

THE DRAWINGS

In the drawings there is illustrated:

FIG. 10 is an outside view of the adapter bracket as mounted on the stud gripper and with the stud gripper positioned on a stud, in phantom, and with two cants, in phantom, positioned on the adapter bracket and the two cants at right angles to the stud;

FIG. 11 is a fragmentary view of the utility bracket looking at one end;

FIG. 15 is an outer end view of the utility bracket, as mounted on the stud gripper and in an operational state with the lower end mounted on a stud, in phantom;

FIG. 16 is a side elevational view of the utility bracket as mounted on a stud gripper which is mounted on a stud, in phantom, and with the lower end of the utility bracket mounted on said stud;

Figure 19:
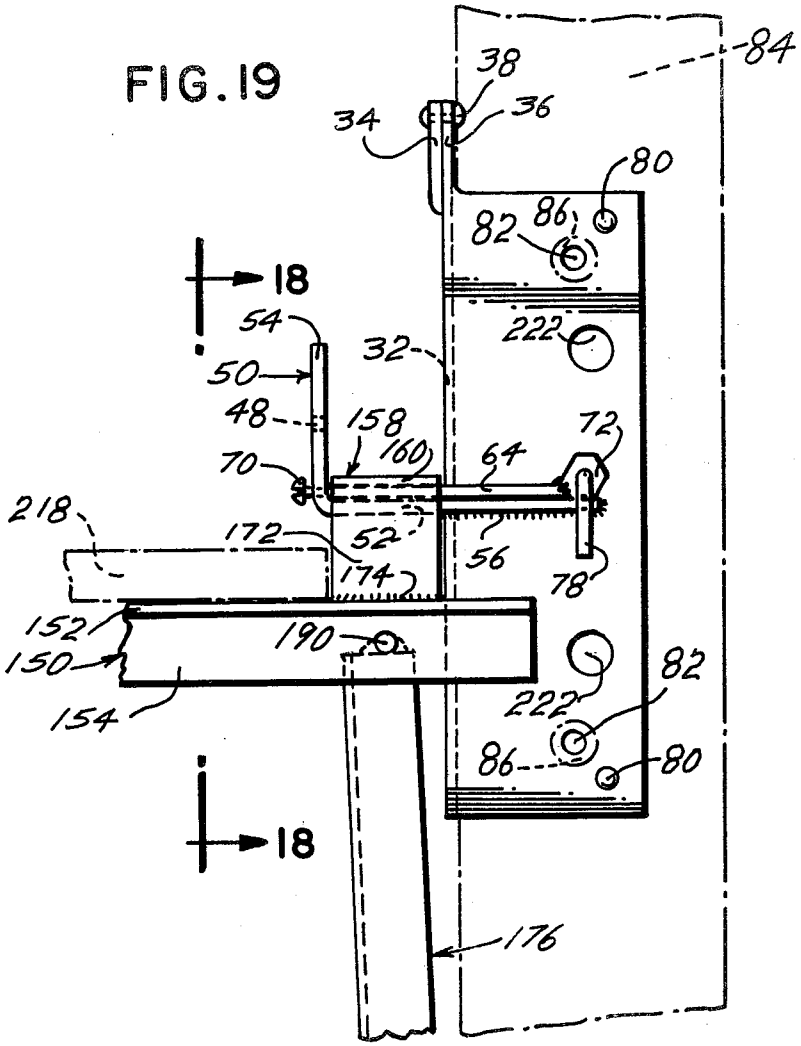
Figure 18:
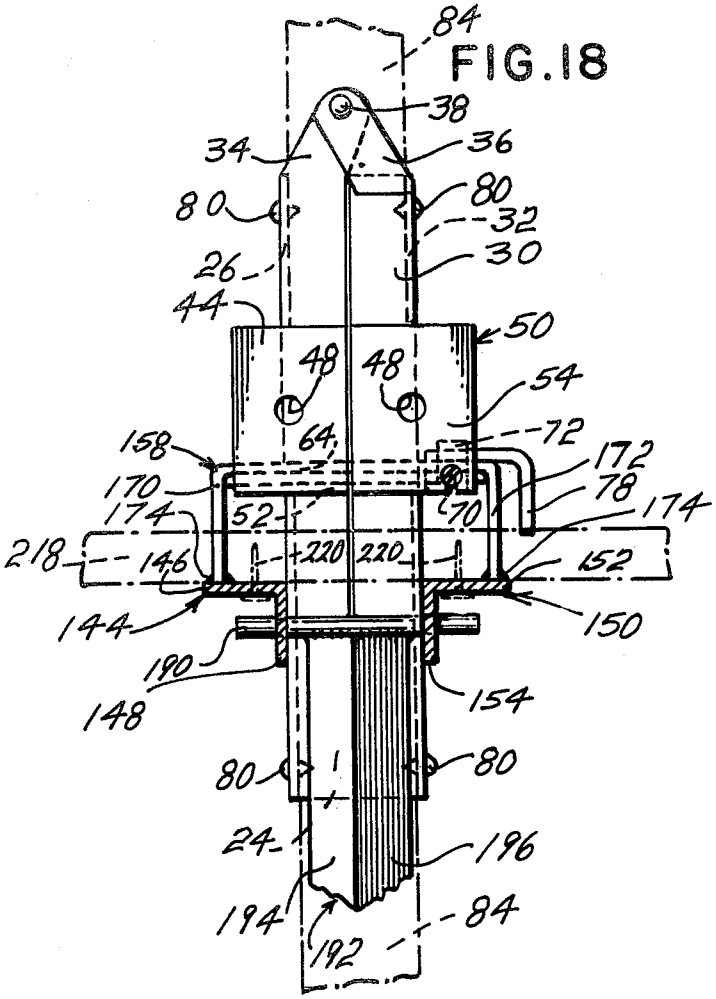
Figure 20:
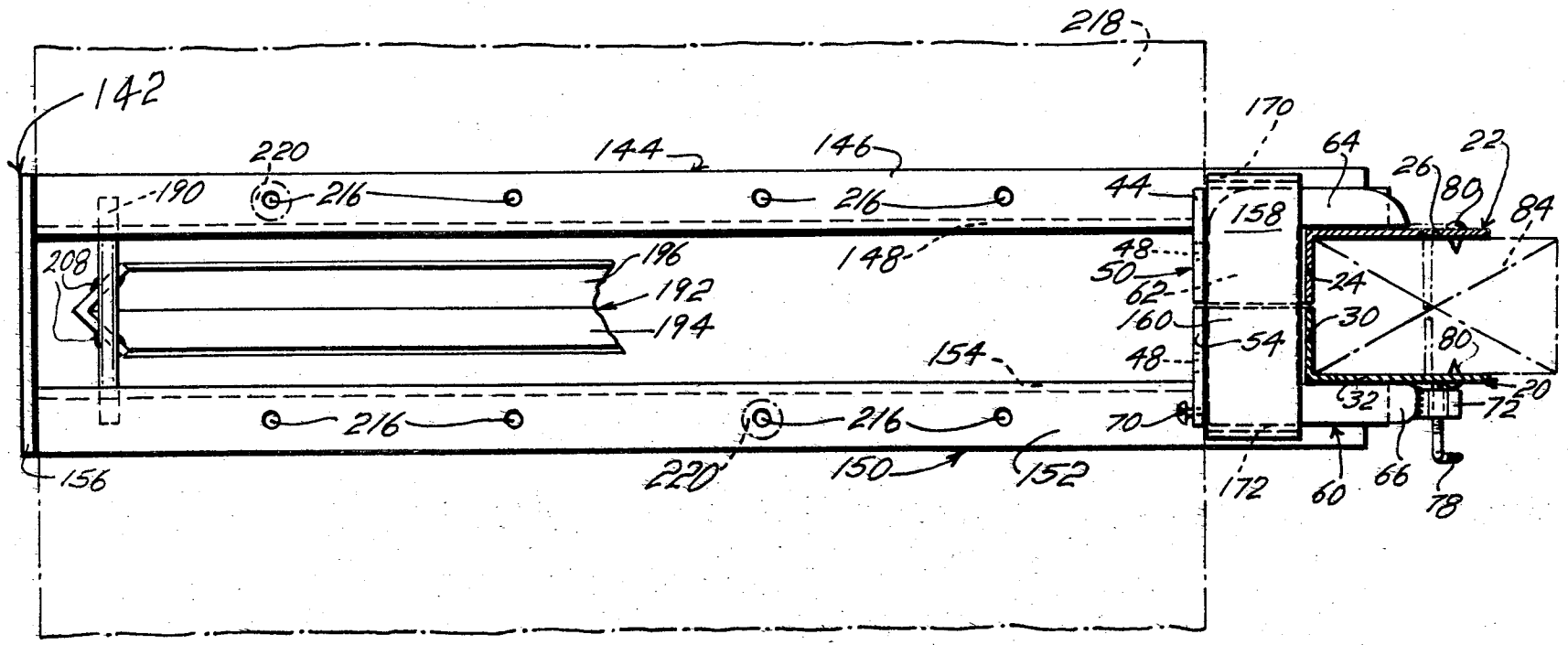
Figure 21:
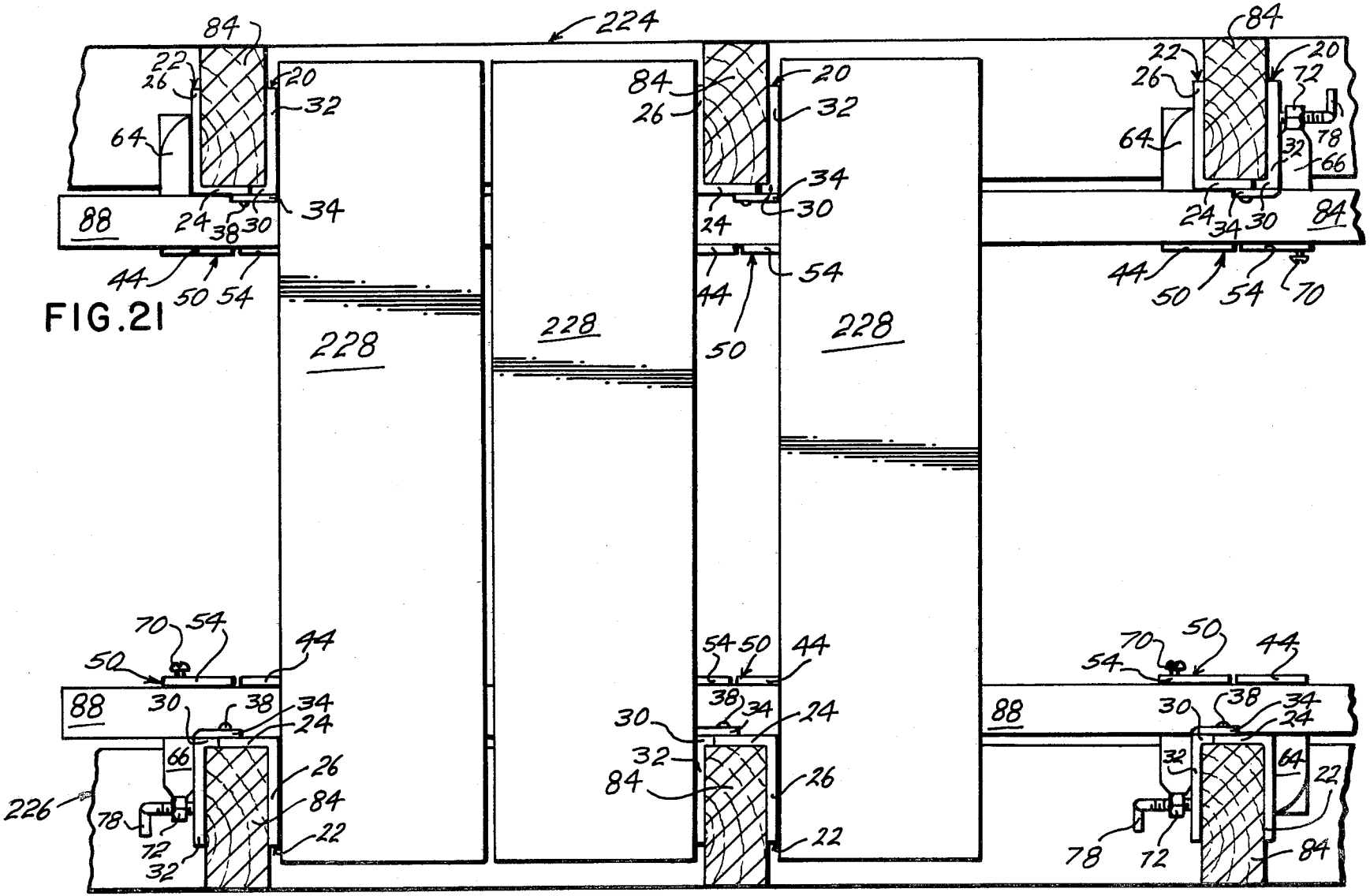
Figure 22:
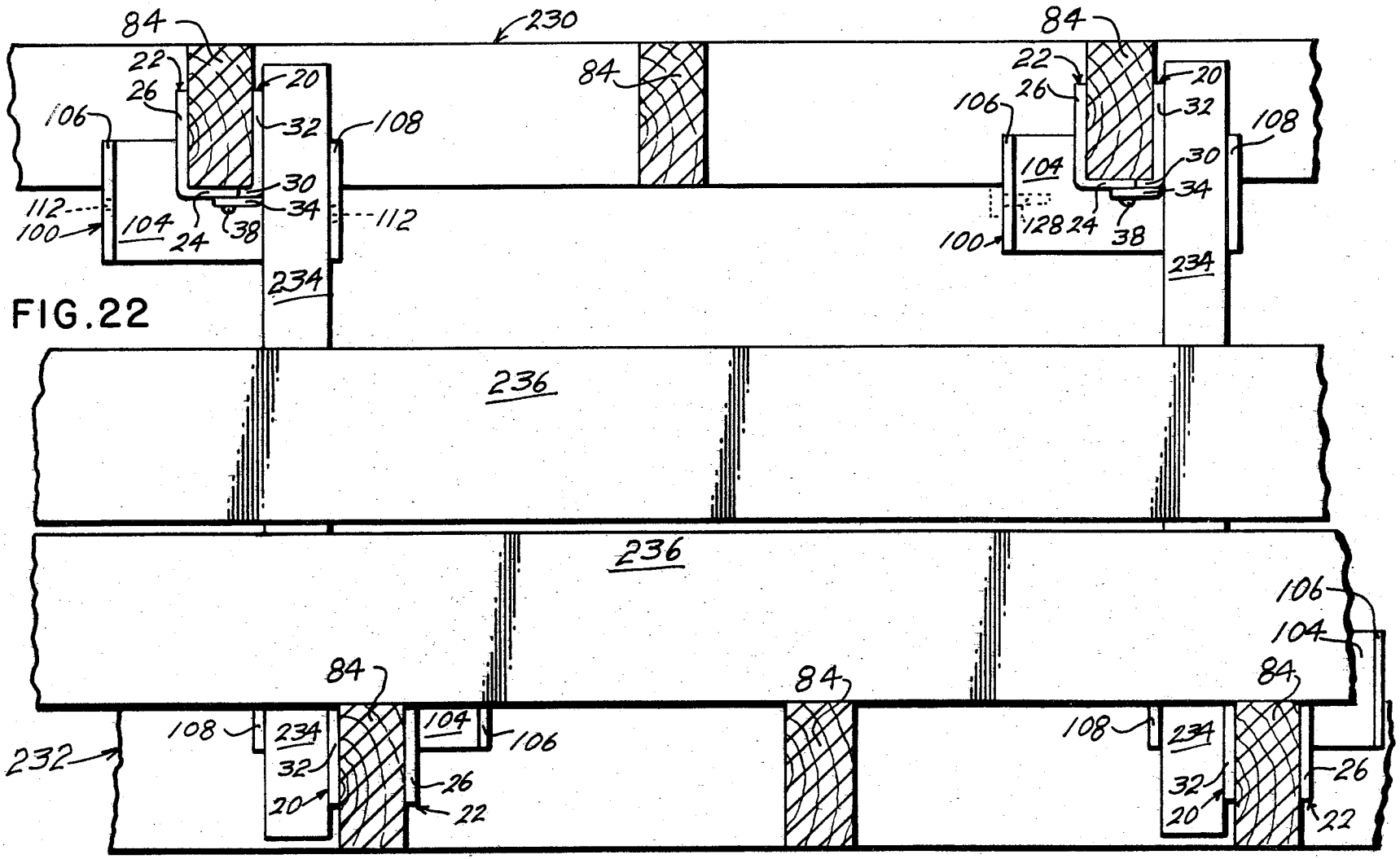
Figure 23:
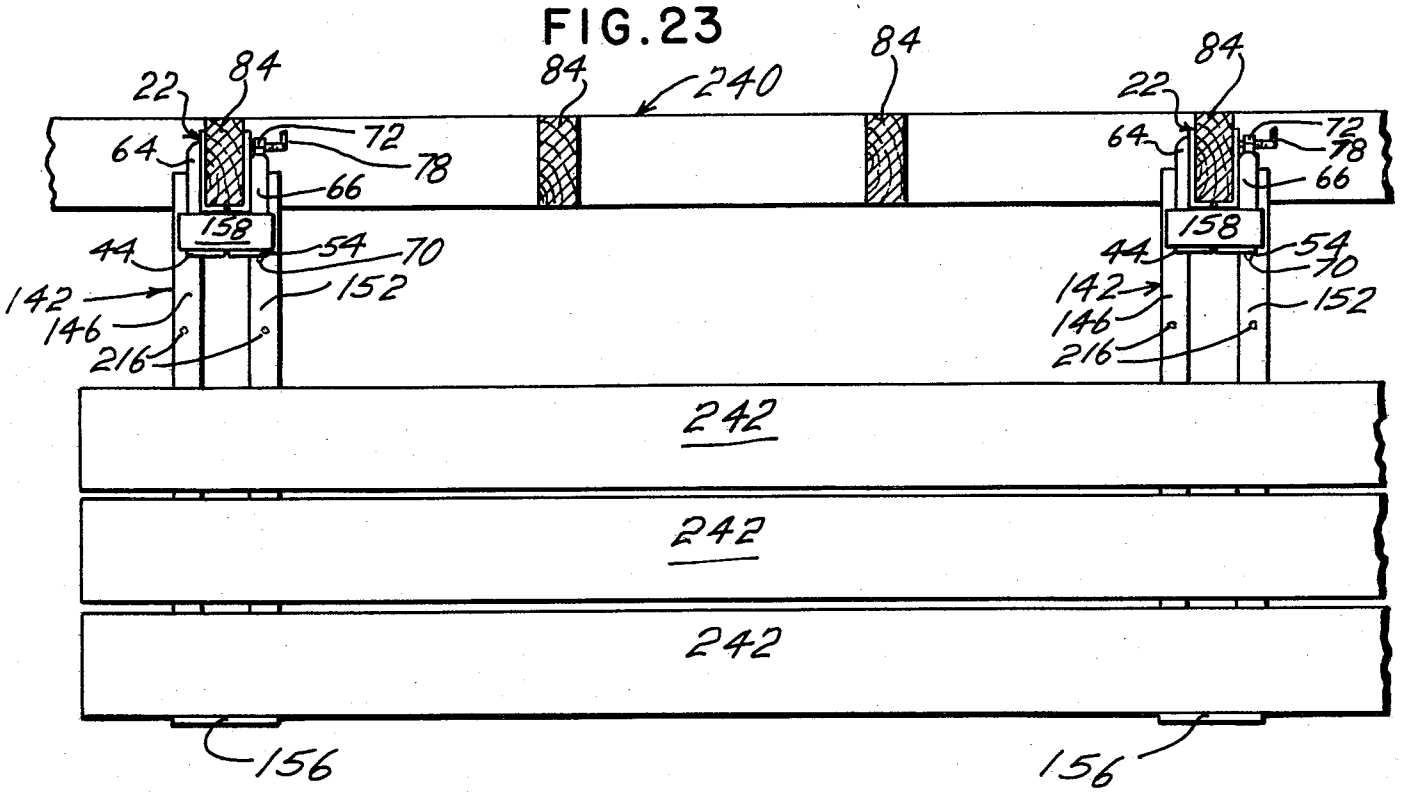

FIG. 17, on an enlarged scale, is a fragmentary view of the lower end of the utility bracket and illustrates the vertical leg brace having a stub leg and also the lower end of the diagonal leg brace for resting on and being positioned by said stub leg;

FIG. 18, on an enlarged scale, is a fragmentary outer end view of the utility bracket as mounted on a stud gripper which is mounted on a stud, in phantom, and also shows the utility bracket supporting a plank;

FIG. 19 is a fragmentary side elevational view illustrating the inner part of the utility bracket as mounted on the stud gripper and which stud gripper is mounted on a stud, in phantom, and shows the utility bracket supporting a plank;

FIG. 20 is a top plan view of the utility bracket as mounted on a stud gripper which is mounted on a stud, in phantom, and shows a plank being supported by said utility bracket;

FIG. 21 is a top plan view illustrating two opposed walls with studs and staging wherein there are spaced apart stud grippers on the walls, cants running parallel to the studs in a wall, and planks placed on the cants for support of workmen;

FIG. 22 is a top plan view showing two opposed walls with studs, wherein the studs may be offset, with stud grippers on the studs and adapter brackets on the stud gripper and cants running between the adapter brackets and planks on the cants for staging; and, FIG. 23 is a top plan view of a wall with studs wherein there are stud grippers on the studs and hanging brackets on the stud grippers and planks on the hanging brackets for staging.

A DETAILED DESCRIPTION OF THE INVENTION

In FIGS. 1–5 there is illustrated a stud gripper 20.

The stud gripper 20 comprises a first longitudinal flange or member 22. The member 22 is essentially an angle iron having a first leg 24 and a second leg 26.

There is a second longitudinal flange or member 28 having a first leg 30 and a second leg 32.

At the upper end of the first leg 24 of the member 22 there is a flange 34.

At the upper end of the first leg 30 of the member 28 there is a flange 36. A pin 38 joins the flanges 34 and 36.

The member 22 and the member 28 are capable of rotating around the pin 38.

Approximately midway on the member 22 or a little bit close to the flange 34 there is a first bracket 40 which is attached to the first leg 24, on the outer surface of the first leg 24. The first bracket 40 comprises a base 42 which is at right angles to the leg 24 and is directed away from the leg 24. The bracket 40 also comprises an upright leg 44 which connects with the base 42. The leg 44 is at right angles to the base 42 and is parallel to the leg 24. The upright leg 44 is spaced-apart from the leg 24.

The base 42 connects with the leg 24 by means of weld 46.

On the outer surface of the leg 30 there is a second bracket 50. The bracket 50 comprises a base 52 and an upright leg 54. The base 52 is at right angles to the leg 30. The upright leg 54 is at right angles to the base 52 and is, substantially, parallel to the leg 30. The base 52 connects with the legs 30 and 32 by means of weld 56.

In the base 52 and the upright leg 54 there is a slot 58.

There is a U-clamp 60 having a base 62, a first leg 64 and a second leg 66. The U-clamp 60 has a recess 68.

A pin or bolt or keeper 70 is positioned in the slot 58 with the head of the bolt on the outside of the second bracket 50 and the inner part connecting with the U-clamp 60.

On the free end of the first leg 64 there is a nut 72. The nut 72 and the U-clamp 60 are joined by weld 74.

A threaded rod 76 is screwed into the nut 72. On the outer end of the threaded rod 76 there is a handle 78.

In the upright leg 44 there is a hole or passageway 48 and, likewise, in the upright leg 44 there is a hole or passageway 48.

It is seen that in the legs 26 and 32 that there are pointed pins 80 or inwardly directed pins or spikes 80 for biting into a stud 84.

In the leg 26 and in the leg 32 there are holes or passageways 82.

Figure 3:
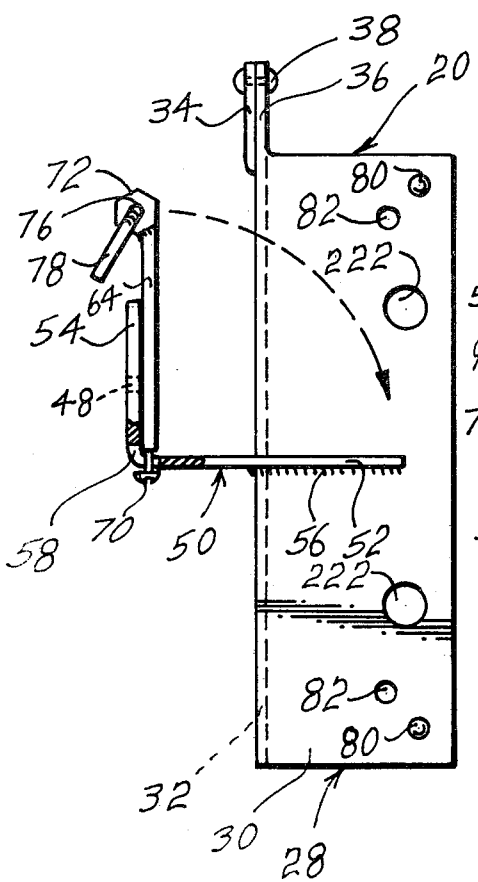
FIG. 3 is a side elevational view of the stud gripper and illustrates the clamp in an upright position.
Figure 6:
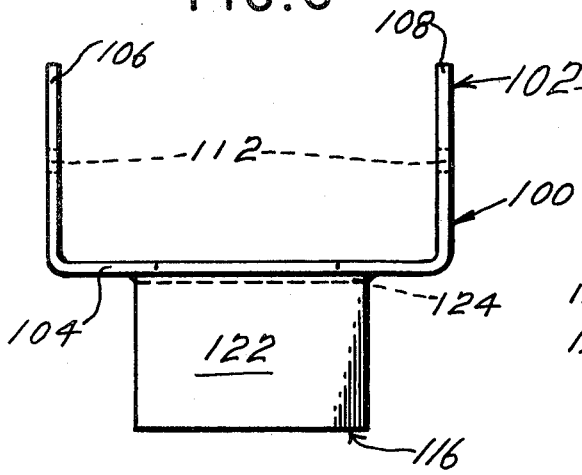
FIG. 6 is a front elevational view of an adapter bracket which is used with the stud gripper.
Figure 7:
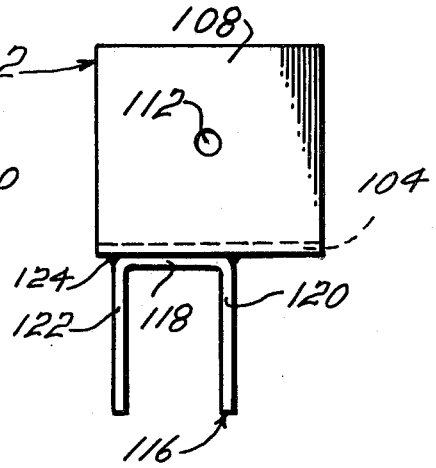
FIG. 7 is a side elevational view of the adapter bracket.
Figure 8:
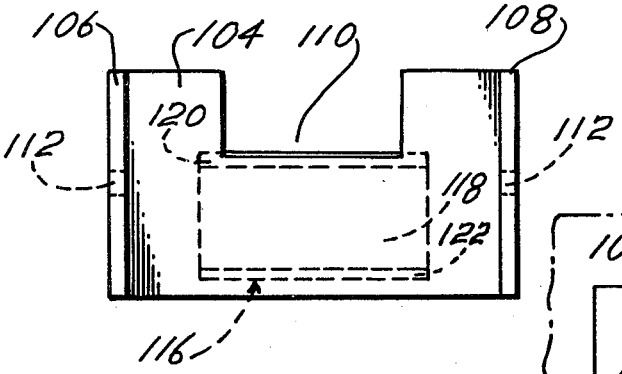
FIG. 8 is a top plan view of the adapter bracket.
Figure 9:
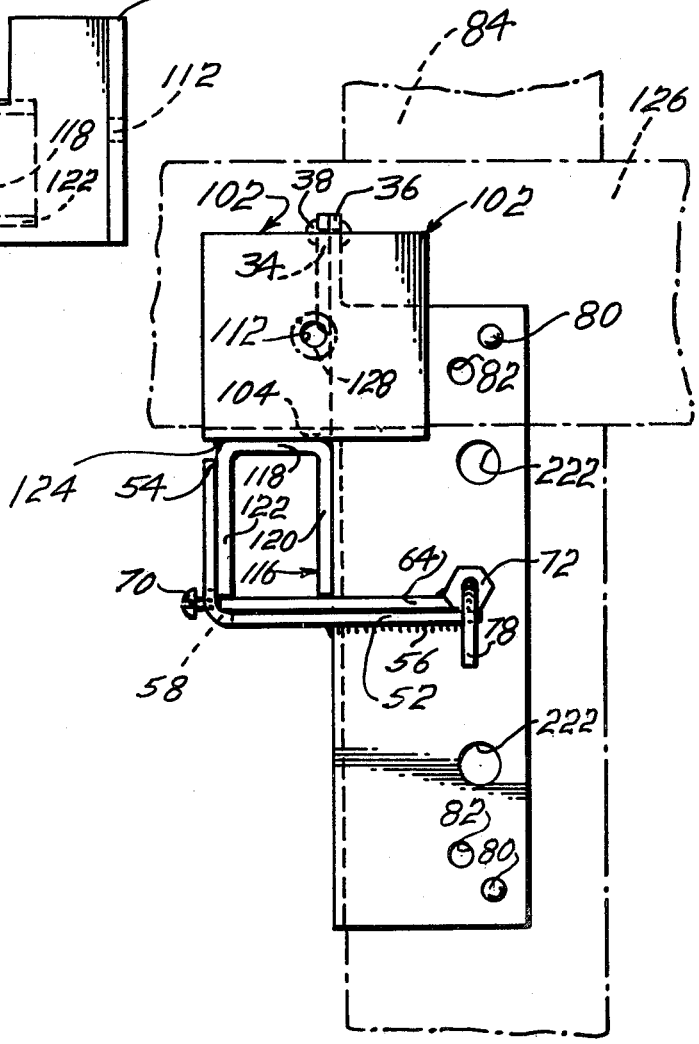
FIG. 9 is a side elevational view of the adapter bracket mounted on the stud gripper, and with the stud gripper mounted on a stud and a cant, such as a two-by-four, positioned on the adapter bracket at a right angle to the stud.

In operation the U-clamp 60 is rotated upwardly so that the base 62 and the legs 64 and 66 are substantially parallel to the legs 24 and 30, see FIG. 3. Also, the member 22 is rotated away from the member 28, see FIGS. 1 and 2.

The stud gripper 20 can be positioned next to a stud 84 and the members 22 and 28 rotated towards each other. The U-clamp 60 is then rotated downwardly so that the leg 66 is on the outside of the leg 26 and the leg 64 is on the outside of the leg 32. The stud gripper is attached or positioned on the stud 84. To insure that the stud gripper is positioned firmly on the stud 84 a person may take a hammer and hit the leg 24 and may hit the leg 32 so that the pointed pins 80 bite into the wooden stud 84. Also, the handle 78 may be rotated so as to lock the U-clamp 60 in a position so that the legs 64 and 66 are on the outside of the legs 24 and 32. The above description is illustrated in FIGS. 4 and 5.

Figure 2:
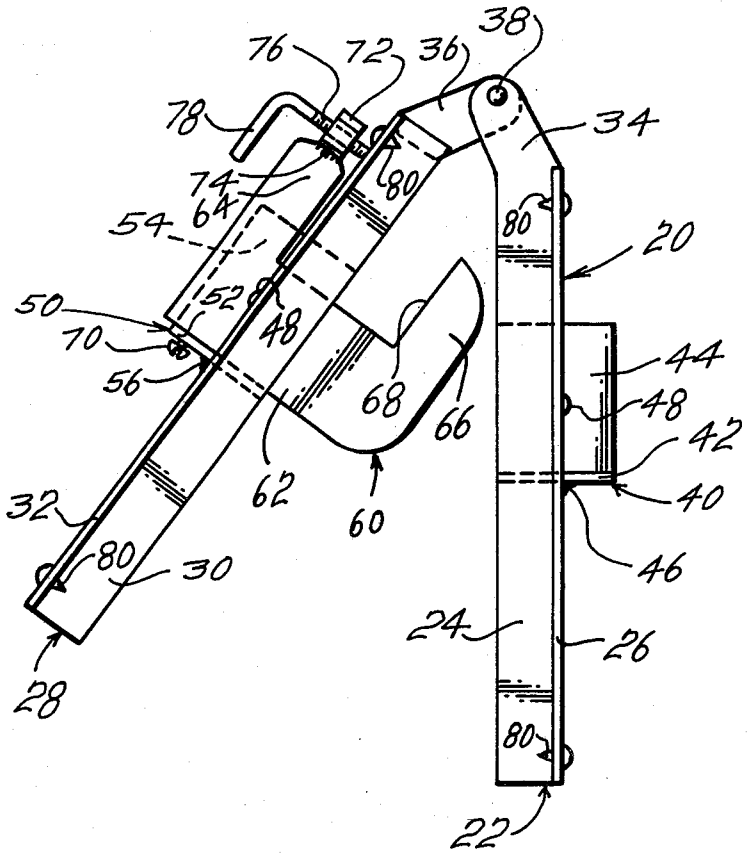
FIG. 2 is an inside view of the stud gripper and illustrates the stud gripper in an open position.
Figure 1:
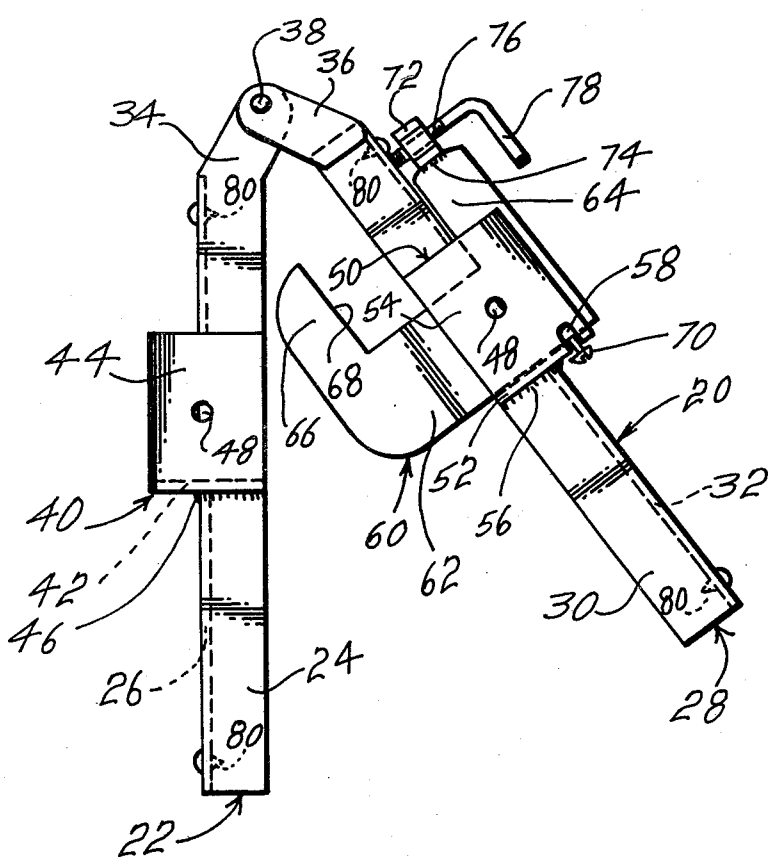
FIG. 1 is an outside view of a stud gripper and illustrates the stud gripper in an open position.
Figure 5:
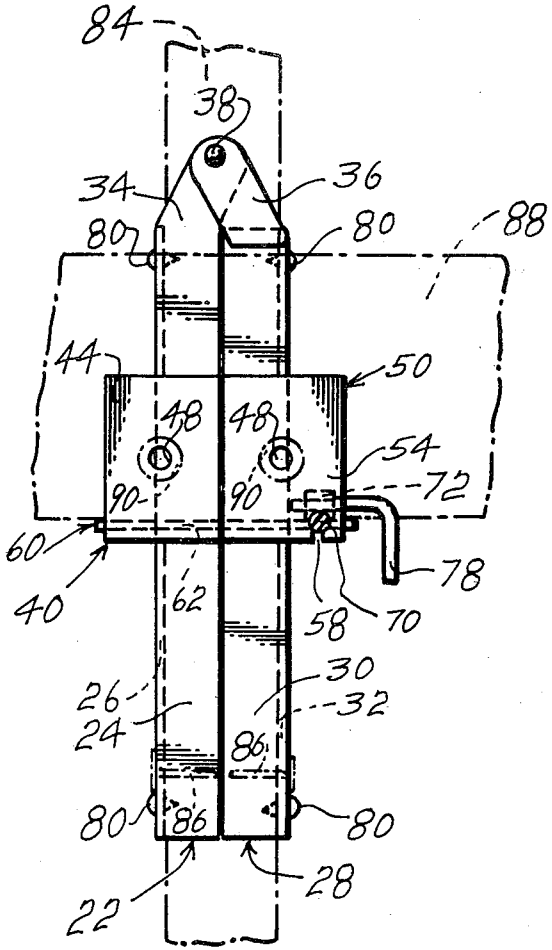
FIG. 5 is an outside view illustrating the stud gripper as attached to a stud, in phantom, and supporting a cant, in phantom.
Figure 4:
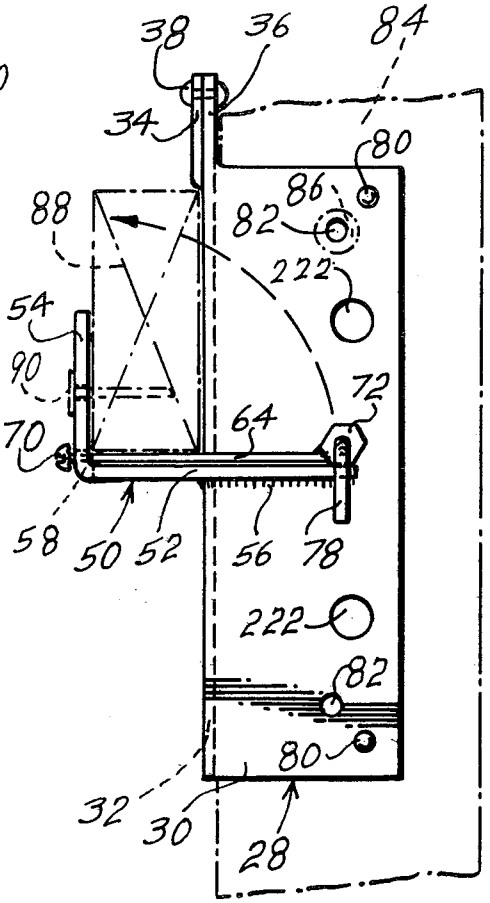
FIG. 4 is a side elevational view of the stud gripper and illustrates the clamp in a locking position with a cant supported by the stud gripper.

It is seen, in FIGS. 4 and 5, that a cant, such as a two-by-four, can be positioned between the legs 44 and 54 of the first bracket and the second bracket and the legs 24 and 30 of the members 22 and 28. In other words, the stud gripper can act as a support, when it is firmly positioned on to and attached to the stud 84, for a two-by-four 88.

Another way of considering this is that in a construction of a building and the construction of a wall, an interior wall or an exterior wall, there is a first set of spaced-apart studs. A first stud gripper can be positioned on one of these studs and a second stud gripper positioned on another stud. Then a two-by-four can be positioned on these two stud grippers. If there is another wall spaced apart from the first wall, a third and fourth stud grippers can be spaced on the studs in the second wall and a two-by-four placed on and supported by the third and fourth stud grippers. A plank or planks can be positioned between the two-by-fours and a workman or workmen can walk on the planks for attaching wall board to the ceiling or placing wire in the ceiling or plumbing in the ceiling.

Further, the stud grippers can be used for supporting a substantially co-planar object such as wall board or sheet rock. The wall board or sheet rock can be positioned between the upright leg 44 of the first bracket 40 and the upright leg 54 of the second bracket 50 so that the wall board or sheet rock is positioned by the base 42 and also the base 52 of these brackets. Then, the sheet rock from this intermediate position can be lifted so as to be positioned on the ceiling of the room.

From the foregoing it is seen that the stud gripper has use in being able to support cants adjacent to studs in a first wall and to studs in a second wall and to place planks or other cants onto the two-by-fours supported by the stud grippers so that a workman can walk on the planks for further work in the building under construction. Another use is to assist in supporting wall board when the wall board is being positioned to be attached to the building such as being attached to a ceiling in a building under construction.

As an added safety feature, nails 86 may be driven through holes or passageways into the stud 84 so as to add a little more positive action in positioning the stud gripper 20 onto the stud 84. Also, nails 90 may be driven through the holes or passageways 48 to more definitely and more firmly position the cant or two-by-four 88 in the stud gripper 20.

In FIGS. 6–10 there is illustrated an adapter bracket 100 comprising a positioning structure 102. The positioning structure 102 comprises a base 104 and first leg 106 and second leg 108.

In the base 104 there is a recess 110. The recess 110 defines a first side and a second side.

In the legs 106 and 108 there are passageways 112. There is a support structure 116 of a, generally, U configuration, having a base 118, a first leg 120 and a second leg 122.

It is seen that the positioning structure 102 is opened upwardly and that the support structure 116 is opened downwardly.

The base 104 is joined with the base 118 by weld 124.

In operation the positioning structure is positioned in the stud gripper 20 with the support structure 116 resting on the base 42 of the first bracket 40 and the base 52 of the second bracket 50. The recess 110 fits around the members 22 and 28 so that the first side fits around the leg 26 and the second side fits around the leg 32. The positioning structure 102 acts as a further lock to lock the stud gripper onto the stud 84.

In FIG. 10 it is seen that two cants 126 or two two-by-fours can be positioned on the base 104 with one of the cants 126 on one side of the stud gripper or on the outside of the member 22 and the other cant 126 on the other side of the stud gripper or on the outside of the member 28.

In the construction of a building with two opposed walls a first stud gripper may be placed on a stud in a first set of studs in the first wall and a second stud gripper may be placed on a stud in the spaced-apart studs of a second set of studs, then the adapter bracket 100 can be positioned in the two stud grippers and two cants 126 run between the two sets of stud grippers on the opposed walls.

This may be repeated on another set of studs in the two walls. Then, there are four cants 126 for supporting a plank or planks which can be positioned on these cants. In this manner, it is possible to have an elevated working platform for workmen to do wiring in the ceiling, plumbing in the ceiling, or place wall board or sheet rock onto the ceiling.

This may be considered to be a building having a first set of spaced-apart studs and a second set of spaced-apart studs. Then, there is positioned a first part of a first cant adjacent to said first set of spaced-apart studs and a second part of said first cant adjacent to said second set of said spaced-apart studs. The process can be repeated for a second cant whereby a first part of a second cant is placed adjacent to the first set of spaced-apart studs and a second part of the second cant is placed adjacent to the second set of spaced-apart studs. Then, a plank can be placed between the two cants for a platform on which a workman can walk to assist in completing the construction of the building.

In FIG. 10 it is seen that nails 128 can be driven through the passageway 112 and into the cants 126 to more definitely position the cants with respect to the adapter bracket 100 and also with respect to the stud gripper 20.

In FIGS. 11–20 there is illustrated the combination of a utility bracket 140 and the stud gripper 20.

The utility bracket 140 comprises a horizontal support arm 142. Actually, the horizontal support arm 142 comprises a left member 144. The left member 144 is an angle iron having a horizontal first leg 146 and a vertical second leg 148. Also, the support arm 142 comprises a right member 150 which is an angle iron. The member 150 comprises a horizontal leg 152 and a vertical leg 154. The left member 144 and the right member 150 are spaced-apart.

On the outer end of the support arm 142 there is a plate 156. The plate 156 is welded to the end or a left member 144 and the end of the right member 150. This positions the outer end of these two members.

On the inner end of the support arm 142 there is a hanging bracket 158. The bracket 158 is in an inverted U-configuration and comprises a base 160, a first leg 170 and a second leg 172. The leg 170 connects with the leg 146 of the arm 142 by means of weld 174 and the leg 172 connects with the leg 152 of the arm 142 by means of weld 174.

By means of the plate 156 and the hanging bracket 158 the two members 144 and 150 are maintained in a fixed, spaced-apart relation.

There is a vertical leg brace 176. This brace 176 may be a U-channel.

On the lower end of the leg brace 176, and positioned to be underneath the stud gripper 20, there is a lower U-brace 180. The brace 180 comprises a base 182, a first leg 184 and a second leg 186. The legs 184 and 186 are adapted to be positioned on opposite surfaces of the stud 84. In the legs 184 and 186 there may be passageways 188.

On the upper end of the leg brace 176 there is a passageway. A pin 190 is positioned in this passageway and runs between the legs 148 and 154 of the horizontal support arm 142. The horizontal support arm 142 and the vertical leg brace 176 can rotate with respect to each other.

There is a diagonal leg brace 192. The brace 192 is an angle iron comprising a first leg 194 and a second leg 196. On the upper end of the brace 192 there is a passageway. A pin 198 is positioned in this passageway and is also positioned in the outer end of the legs 148 and 154 of the horizontal support arm 142. The horizontal support arm 142 and the diagonal leg brace 192 can rotate with respect to each other.

On the lower end or the free end of the diagonal leg brace 192 there are holes 200 in the legs 194 and 196.

On the lower end of the vertical leg brace 176, and on that side of the leg brace away from the lower U-brace 180, there is a stub support 202. The stub support is a short piece of angle iron having a first leg 204 and a second leg 206. The stub support 202 is welded to the leg brace 176 by weld 208.

In the legs 204 and 206 of the stub support 202 there are holes or passageways 210. In operative position the holes 200 and the holes 210 are aligned. A wire or keeper 212 may be passed through the holes 200 and 210 to more securly tie together the stub support 202 and the diagonal leg brace 192.

There may be nails 86 pounded through the holes in the stud gripper 20 and into the stud 80. Also, there may be nails 214 pounded through holes or passageways 188 and the lower U-brace 180 to assist in securing the leg brace to the stud 84.

A support plank 218 may be positioned on the horizontal support arm 142. Nails 220 may be pounded through the nail holes 216 and into the support plank 218 to definitely position the support plank onto the utility bracket 140.

It is seen that in the adapter bracket 20 that there are some large holes 222. These holes 222 are bolt holes. In certain jurisdiction it is required that instead of using nails for attaching a bracket such as the stud gripper 20 there must be used bolts for attaching the stud gripper to the studs. To meet this requirement there are provided bolt holes 222 in the stud gripper 20.

In FIG. 21 there is illustrated two spaced-apart walls, a first wall 224 and a second wall 226. Each of the walls comprises studs 84. The studs 84 in the wall 224 may be aligned with the studs 84 in the wall 226. It is not necessary that the studs in the two wall be aligned.

On two spaced-apart studs in the wall 224 there are positioned stud grippers 20. On two spaced-apart studs 84 in the wall 226 there are positioned stud grippers 20. The stud grippers on the wall 224 support a cant 88. The stud grippers on the wall 226 support a cant 88.

Planks 228 may be positioned on the two spaced-apart cants 88 so as to provide staging for a workman applying wall board or sheetrock to the ceiling, additional wiring or plumbing.

Another way of considering this is that the building comprises a first set of spaced-apart studs in wall 224. There is positioned a cant 88 next to these studs 84 in the wall 224. A second cant such as plank 228 can be positioned on the cant 88. A third cant 88 can be positioned adjacent to the studs 84 in the wall 226. Then, the second cant or plank can be positioned on the first cant 88 adjacent to the wall 224 and can be positioned and supported on the cant 88 in the wall 226.

In FIG. 22 it is seen that there is a first wall 230 having studs 84. There is also a second wall 232 having studs 84. The studs 84 in the wall 230 may or may not be aligned with the studs 84 in the wall 232. In FIG. 22 the studs 84 in the wall 230 are not aligned with the studs 84 in the wall 232.

There is positioned on spaced-apart studs 84 in the wall 230 stud grippers 20. On each stud gripper 20 there is positioned an adapter bracket 100.

There is positioned on spaced-apart studs 84 in the wall 232 grippers 20 and there is positioned in each stud gripper 20 an adapter bracket 100. A cant 234 can be positioned on the adapter brackets 100 on the stud grippers 20 which are opposed to each other, or, closely, opposed to each other on the studs in the walls 230 and 232. In other words, there are at least two spaced-apart cants 234. Planks 236 can be placed on the cants 234 to assist in providing staging for a workman to apply wall board or sheetrock, apply additional wiring or additional plumbing.

Another way of expressing what is illustrated in FIG. 22 is that there is a building comprising a first set of spaced-apart studs and a second set of spaced-apart studs. There is positioned a first part of a first cant adjacent to said first set of spaced-apart studs and there is positioned a second part of said first cant adjacent to said second set of spaced-apart studs. Then, there can be positioned a first part of a second cant adjacent to said first set of spaced-apart studs and there can be positioned a second part of said second cant adjacent to said second set of spaced-apart studs. The first cant and the second cant are spaced apart. There is positioned a third cant on the said first cant and on the said second cant with the first cant and the second cant supporting said third cant or the third cant being a plank or planks.

In FIG. 23 there is illustrated a wall 240 having spaced-apart studs 84. On two of the spaced-apart studs there is applied a stud gripper 20. Then, on each of the stud grippers 20 there is applied a hanging bracket 158. A cant or a plank 242 can be positioned onto two spaced-apart hanging brackets 158 to assist in providing staging for a workman to apply sheetrock or wall board to the ceiling, to wire the building or to provide plumbing in the building.

Another way of expressing what is illustrated in FIG. 23 is that there is a building comprising a first set of spaced-apart studs. Then there is positioned a first support on a first stud of one of said studs. There is positioned a second support on a second stud of one of said studs. The first support and the second support are spaced apart. Then, there is positioned a cant on the first support and on the second support with the first support and the second support supporting said cant or said plank 242.

Figure 12:
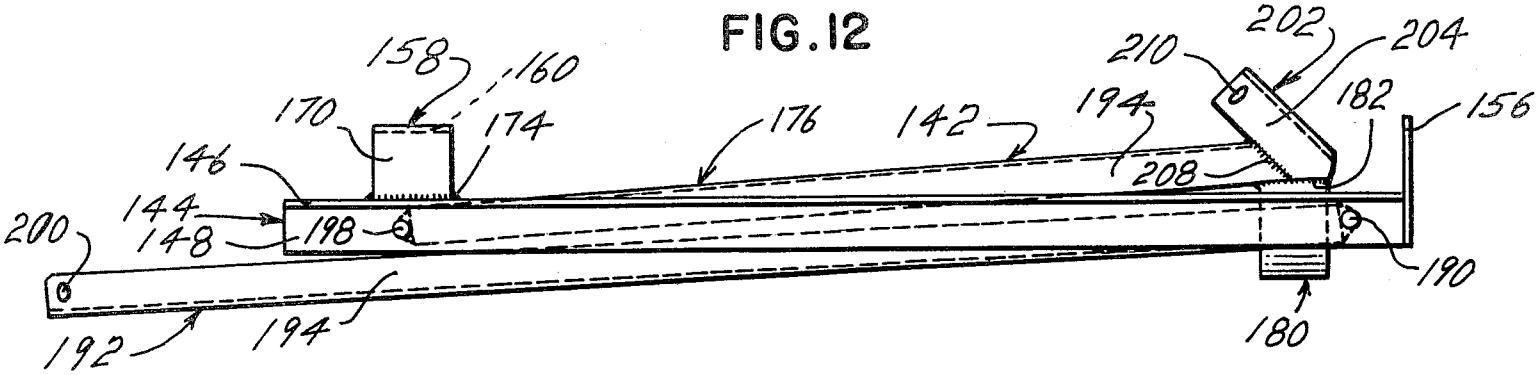
FIG. 12 is a side elevational view of the utility bracket, in a folded state, for ease of transportation and storage.
Figure 13:
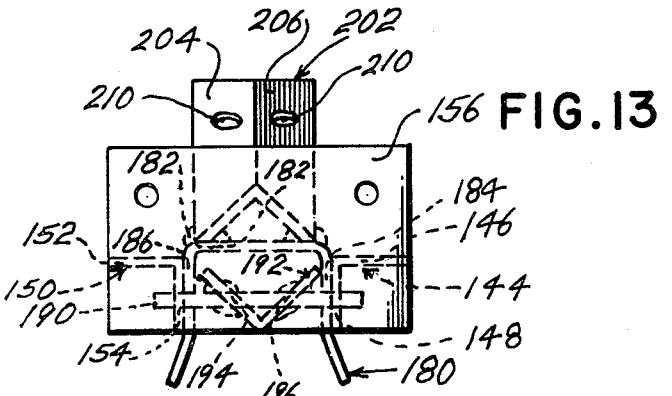
FIG. 13 is an outer end elevational view of the utility bracket in a folded state for ease of transportation and storage.
Figure 14:
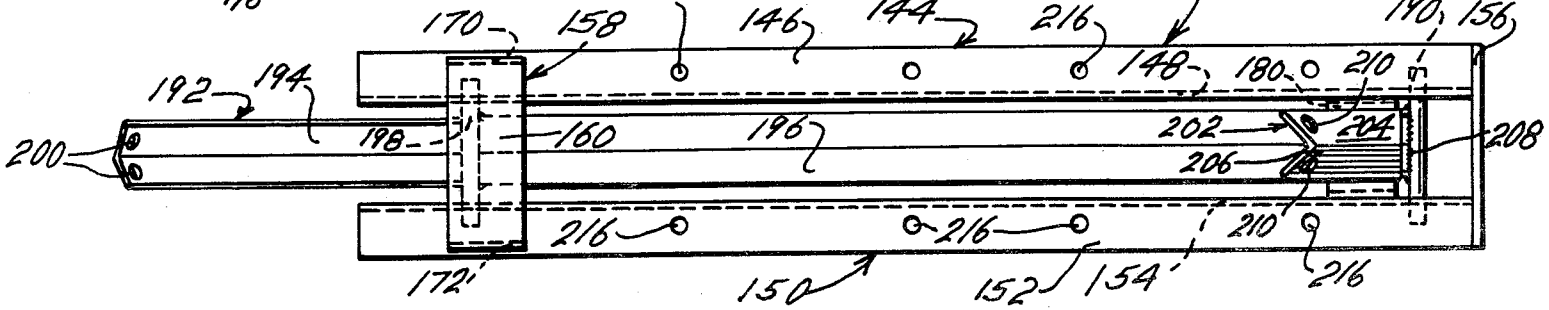
FIG. 14 is a top plan view of the utility bracket, in a folded state, for ease of transportation and storage.

In FIGS. 12, 13, and 14 there is illustrated the utility bracket 140 in a folded state so as to occupy a small volume. With the utility bracket in a folded state it is easy to transport the same in the trunk of an automobile or in the bed of a pickup truck.

I consider some of the advantages of the invention comprising the stud gripper and the accessories or the stud gripper, the adapter bracket, and the utility bracket, to be the fact that these articles are easily and quickly applied to the studs in a building under construction. These articles can be used to assist in the making of stagings for work in the building. Also, these articles are easily and quickly removed from the studs in a building under construction. Another advantage is that the stud gripper, adapter bracket and utility bracket can be used more than once. They are inexpensive components in staging used in the construction of a building. Also, the hanging bracket can be folded to occupy a small volume, either when in storage or when being transported from one job to another job. The stud gripper and the adapter bracket are of a small volume and can be stored in a place with only a small volume available for storage or can be readily transported in the trunk of an automobile or in the bed of a pickup truck.

In the preparation of this patent application I did not make a patent search. On Jan. 24, 1978 I received U.S. Pat. No. 4,070,013 entitled "Stud Gripping Clamp". The references cited in the prosecution of that patent were:

| Name | Number |
|---|---|
| FROBERG | 512,543 |
| DIFLO | 966,387 |
| HEIDBRINK ET AL | 1,031,928 |
| UPDIKE | 1,036,168 |
| MILLER | 1,085,353 |
| ALLEN | 1,419,193 |
| VIDON | 1,562,391 |
| CAMPFIELD | 3,083,007 |
| United Kingdom | 26,765 of 1904 |

I consider the subject invention to distinguish from my Pat. No. 4,070,013 in that the stud gripper of this invention comprises two members which are joined by a pin and rotate toward and away from each other. Also, the subject matter of this invention comprises an adapter bracket for working with the stud gripper and also comprises a utility bracket for working with the stud gripper. The subject of this invention is more complicated and can be used more extensively than the subject of my stated patent. In my stated patent there is a fixed member for clamping onto one side of a stud and there is a moveable member which can be clamped onto the other side of the stud. There is a handle 26 for moving a flange 38 to further assist in clamping the members to the two sides of the stud. The subject matter of the stated patent is restricted to a stud-gripping clamp and does not encompass an adapter bracket and a utility bracket.

The subject matter of this invention makes it possible to use different types of staging and different staging in the construction of a building than the subject matter of the stated patent. Therefore, I consider that the subject matter of this invention distinguishes over the subject matter of the stated patent.

From the foregoing and having presented my invention what I claim is:

1. A gripping device comprising:
a. a first member and a second member;
b. a first means uniting said first member and said second member;
c. said first member and said second member being capable of moving with respect to each other;
d. when said first member and said second member are, substantially, parallel, a second means, operatively, connecting with one of said members to hold in a fixed position said first member and said second member;
e. a third means on one of said members and directed toward the other member, when said members are facing each other, for making an indentation into an article between said members and to assist in holding said gripping device in position on said article;
f. said second means comprising a bracket connecting with one of said members;
g. a clamping device connecting with said bracket;
h. said clamping device and said bracket moveable with respect to each other; and,
i. when said members are juxtapositioned to each other and are, substantially parallel, said clamping device moving to a position to maintain said members juxtapositioned to each other and, substantially, parallel to each other.

2. A gripping device according to claim 1 and comprising:
a. said bracket comprising a first leg connecting with one of said members and a second leg;
b. said second leg being at an angle to said first leg; and,
c. said second leg being spaced apart from the member to which the bracket is attached so that said bracket can receive an object.

3. A gripping device according to claim 2 and comprising:
a. said clamping device comprising a U-clamp having a base, a first leg and a second leg; and,
b. when said U-clamp is positioned to maintain said members juxtapositioned to each other the first leg of said clamp is on the outside of one of said members and the second leg of said clamp is on the outside of the other one of said members.

4. A gripping device comprising:
a. a first member and a second member;
b. a first means uniting said first member and said second member;
c. said first member and said second member being capable of moving with respect to each other;
d. when said first member and said second member are, substantially parallel, a second means, operatively, connecting with one of said members to hold in a fixed position said first member and said second member;
e. a third means on one of said members and directed toward the other member, when said members are facing each other for making an indentation into an article between said members and to assist in holding said gripping device in position on said article;
f. said members being capable of rotation around said first member;
g. said members facing each other except when said members define a subtantially straight member;
h. said second means comprising a bracket connecting with one of said members;
i. a clamping device connecting with said bracket;
j. said clamping device and said bracket moveable with respect to each other;
k. when said members are juxtapositioned to each other and are, substantially parallel, said clamping device moving to a position to maintain said members juxtapositioned to each other and, substantially parallel, to each other;
l. said bracket comprising a first leg connecting with one of said members and a second leg;
m. said second leg being at an angle to said first leg;
n. said second leg being spaced apart from the member to which the bracket is attached so that said bracket can receive an object;
o. said clamping device comprising a U-clamp having a base, a first leg and a second leg; and,
p. when said U-clamp is positioned to maintain said members juxtapositioned to each other the first leg of said clamp is on the outside of one of said members and the second leg of said clamp is on the outside of the other one of said members.

5. An adapter bracket comprising:
a. a U-shaped positioning structure having a base, a first leg and a second leg;
b. a support structure underneath said adapter bracket;
c. said legs being directed away from said support structure;
d. said base having a recess for receiving another object;
e. said support structure being underneath said base to allow said base to receive said object;
f. a passageway in at least one of said legs;
g. said support structure being of a U-configuration and having a base, a first leg and a second leg;
h. the base of said adapter bracket and the base of said support structure being connected;
i. the legs of said adapter bracket and the legs of said support structure being, substantially, at right angles; and,
j. the physical dimensions of said support structure being smaller than the physical dimensions of said U-shaped positioning structure.

6. A utility bracket comprising:
a. a horizontal support arm;
b. a vertical leg brace;
c. a diagonal leg brace;
d. said horizontal support arm operatively connecting with said vertical leg brace and said diagonal leg brace;
e. said vertical leg brace operatively connecting with said diagonal leg brace;
f. a brace having two spaced apart outwardly directed arms, on the lower part of said vertical leg brace for connecting with a cant with each of said outwardly directed arms juxtapositioned to a side of said cant;
g. a means juxtapositioned to the upper part of said vertical leg brace for connecting to an object;

h. a first pivot means connecting together said horizontal support arm and said diagonal leg brace;
i. said horizontal support arm and said diagonal leg brace being capable of moving with respect to each other;
j. a second pivot means connecting together said horizontal support arm and said vertical leg brace;
k. said horizontal support arm and said vertical leg brace being capable of moving with respect to each other;
l. said horizontal support arm comprising two spaced apart members;
m. a hanging bracket connecting with said two members;
n. said hanging bracket being positioned on that end of the horizontal support arm near the pivot means between the horizontal support arm and said vertical leg brace and on that side of said horizontal arm away from said vertical leg brace;
o. said vertical leg brace being capable of rotating to lie partically between said two members to assist in making said utility bracket compact;
p. said diagonal leg brace being capable of rotating to lie partically between said two members to assist in making said utility bracket compact;
q. a stub support positioned on said vertical leg brace and juxtapositioned to the lower end of said vertical leg brace; and,
r. with said utility bracket in an operating state said stub support being directed toward the first pivot means connecting together said horizontal support arm and said diagonal leg brace and the free end of said diagonal leg brace operatively connecting with said support stub to position said diagonal leg brace on said support stub.

7. A combination of a gripping device and an adapter bracket:

A. said gripping device comprising:
I. a first member and a second member;
II. a first means uniting said first member and said second member;
III. said first member and said second member being capable of moving with respect to each other;
IV. when said first member and said second member are, substantially, parallel, a second means, operatively, connecting with one of said members to hold in a fixed position said first member and said second member;
V. a third means on one of said members and directed toward the other member, when said members are facing each other, for making an indentation into an article between said members and to assist in holding said gripping device in position on said article.

B. said adapter bracket comprising:
VI. a U-shaped positioning structure having a base, a first leg and a second leg;
VII. a support structure underneath said adapter bracket;
VIII. said legs being directed away from said support structure; and, C. said adapter bracket being positioned on said second means.

8. A combination of a gripping device and an adapter bracket according to claim 7 and comprising:
a. said second means comprising a bracket connecting with one of said members;
b. a clamping device connecting with said bracket;
c. said clamping device and said bracket moveable with respect to each other; and,
d. when said members are juxtapositioned to each other and are, substantially, parallel, said clamping device moving to a position to maintain said members juxtapositioned to each other and, substantially, parallel to each other; and,
e. a recess in the base of said adapter bracket for receiving allowing said adapter bracket to receive said two members of said gripping device and to partially fit around said two members.

9. A combination of a gripping device and an adapter bracket according to claim 8 and comprising:
a. said bracket comprising a first leg connecting with one of said members and a second leg;
b. said second leg being at an angle to said first leg; and,
c. said second leg being spaced apart from the member to which the bracket is attached so that said bracket can receive said adapter bracket.

10. A combination of a gripping device and an adapter bracket according to claim 9 and comprising:
a. said clamping device comprising a U-clamp having a base, a first leg and a second leg; and,
b. when said U-clamp is positioned to maintain said members juxtapositioned to each other the first leg of said clamp is on the outside of one of said members and the second leg of said clamp is on the outside of the other one of said members.

11. A combination of a gripping device and an adapter bracket according to claim 9 and comprising:
a. said support structure being of a U-configuration and having a base, a first leg and a second leg;
b. the base of said adapter bracket and the base of said support structure being connected; and,
c. the legs of said adapter bracket and the legs of said support structure being, substantially, at right angles.

12. A combination of a gripping decive and an adapter bracket according to claim 9 and comprising:
a. said clamping device comprising a U-clamp having a base, a first leg and a second leg; and,
b. when said U-clamp is positioned to maintain said members juxtapositioned to each other the first leg of said clamp is on the outside of one of said members and the second leg of said clamp is on the outside of the other one of said members.

13. A combination of a gripping device and a utility bracket:

A. said gripping device comprising:
I. a first member and a second member;
II. a first means uniting said first member and said second member;
III. said first member and said second member being capable of moving with respect to each other;
IV. when said first member and said second member are, substantially, parallel a second means, operatively, connecting with one of said members to hold in a fixed position said first member and said second member; and,
V. a third means on one of said members and directed toward the other member, when said members are facing each other, for making an identation into an article between said members and to assist in holding said gripping device in position on said article;

B. said utility bracket comprising:
VI. a horizontal support arm;
VII. a vertical leg brace;
VIII. a diagonal leg brace;
IX. said horizontal support arm operatively connecting with said vertical leg brace and sid diagonal leg brace;
X. said vertical leg brace operatively connecting with said diagonal leg brace;
XI. a brace on the lower part of said vertical leg brace for connecting with an object;
XII. a means juxtapositioned to the upper part of said vertical leg brace for connecting to an object;
XIII. a hanging bracket on the inner end of said horizontal support arm; and,
C. said hanging bracket, operatively, connects with said second means to support said utility bracket on said gripping device.

14. A combination of a gripping device and a utility bracket according to claim 13 and comprising:
a. said members being capable of moving in a, substantially, complete circle;
b. said members facing each other except when said members define a substantially straight member;
c. a pivot means connecting together said horizontal support arm and said diagonal leg brace;
d. said horizontal support arm and said diagonal leg brace being capable of moving with respect to each other;
e. a pivot means connecting together said horizontal support arm and said vertical leg brace; and,
f. said horizontal support arm and said vertical leg brace being capable of moving with respect to each other.

15. A combination of a gripping device and a utility bracket according to claim 13 and comprising:
a. said second means comprising a bracket connecting with one of said members;
b. a clamping device connecting with said bracket;
c. said clamping device and said bracket moveable with respect to each other;
d. when said members are juxtapositioned to each other and are, substantially, parallel said clamping device moving to a position to maintain said members juxtapositioned to each other, and, substantially, parallel to each other;
e. said horizontal support arm comprising a member offset from said vertical leg brace and said diagonal leg brace;
f. said vertical leg brace being capable of rotating to lie alongside said member to assist in making said utility bracket compact; and,
g. said diagonal leg brace being capable of rotating to be alongside said member to assist in making said utility bracket compact.

16. A combination of a gripping device and a utility bracket according to claim 15 and comprising:
a. said bracket comprising a first leg connecting with one of said members and a second leg;
b. said second leg being at an angle to said first leg;
c. said second leg being spaced apart from the member to which the bracket is attached so that said bracket can receive an object;
d. a stub support positioned on said vertical leg brace and juxtapositioned to the lower end of said vertical leg brace; and,
e. with said utility bracket in an operating state said stub support directed toward the pivot means connecting together said horizontal support arm and said diagonal leg brace and the free end of said diagonal leg brace connecting with said support stub.

17. A combination of a gripping device and a utility bracket according to claim 16 and comprising:
a. said clamping device comprising a U-clamp having a base, a first leg and a second leg;
b. when said U-clamp is positioned to maintain said members juxtapositioned to each other the first leg of said clamp is on the outside of the other one of said members;
c. said horizontal support arm comprising two spaced-apart members;
d. a hanging bracket connecting with said two spaced-apart members;
e. said hanging bracket being positioned on that end of the horizontal support arm near the pivot means between the horizontal support arm and said vertical leg brace and on that side of said horizontal support arm away from said vertical leg brace;
f. said vertical leg brace being capable of rotating to lie partially between said two members to assist in making said utility bracket compact;
g. said diagonal leg brace being capable of rotating to lie partially between said two members to assist in making said utility bracket compact;
h. a stub support positioned on said vertical leg brace and juxtapositioned to the lower end of said vertical leg brace; and,
i. with said utility bracket in an operating state said stub support directed toward the pivot means connecting together said horizontal support arm and said diagonal leg brace and the free end of said diagonal leg brace connecting with said support stub.

18. A combination of a gripping device and a first cant, said combination comprising:
a. a first member and a second member;
b. a first means uniting said first member and said second member;
c. said first member and said second member being capable of moving with respect to each other;
d. when said first member and said second member are, substantially parallel, a second means operatively connecting with one of said members to hold in a fixed position said first member and said second member;
e. a third means on one of said members and directed toward the other member, when said members are facing each other, for making an indentation into said first cant between said members and to assist in holding said gripping device in position on said first cant;
f. said second means comprising a bracket connecting with one of said members;
g. a clamping device connecting with said bracket;
h. said clamping device and said bracket moveable with respect to each other; and,
i. when said members are juxtapositioned to each other on said first cant and are, substantially parallel said clamping device moving to a position to maintain said members juxtapositioned to each other on said first cant and, substantially parallel to each other on said first cant.

19. A combination of a gripping device and a first cant according to claim 18 and comprising:
a. said bracket comprising a first leg connecting with one of said members and a second leg;
b. said second leg being at an angle to said first leg; and,
c. said second leg being spaced apart from the member to which bracket is attached so that said bracket can receive an object.

20. A combination of a gripping device and a first cant according to claim 19 and comprising:
a. said object being, substantially, coplanar as its length and width are many times greater than its thickness.

21. A combination of a gripping device and a first cant according to claim 19 and comprising:
a. said object being wall board.

22. A combination of a gripping device and a first cant according to claim 19 and comprising:
a. said object being a second cant;
b. said first cant being, substantially, vertical; and,
c. said second cant being, substantially, horizontal.

23. A combination of a gripping device and a first cant according to claim 22 and comprising:
a. said combination comprising a first said gripping device on a first cant and a second said gripping device, spaced-apart from said first said gripping device, on another cant; and,
b. said second cant positioned on and extending between said gripping devices and being juxtapositioned to said first cant.

24. A combination of a gripping device, an adapter bracket and a first cant, said combination comprising:
A. said gripping device comprising:
I. a first member and a second member;
II. a first means uniting said first member and said second member;
III. said first member and said second member being capable of moving with respect to each other;
IV. when said first member and said second member are substantially, parallel a second connecting means, operatively connecting with one of said members to hold in a fixed position said first member and said second member;
B. said adapter bracket comprising:
VI. a U-shaped positioning structure having a base, a first leg and a second leg;
VII. a support structure underneath said adapter bracket;
VIII. said legs being directed sway from said support structure;
C. said adapter bracket connecting with and being supported by said gripping device; and,
D. a third means on one of said members and directed toward the other member, when said members are facing each other, for making an indentation into said first cant between said members and to assist in holding said gripping device in position on said first cant.

25. A combination of a gripping device, an adapter bracket and a first cant according to claim 24 and comprising:
a. said members being capable of moving in a, substantially, complete circle; and,
b. said members facing each other except when said members define a substantially straight member.

26. A combination of a gripping device, an adapter bracket and a first cant according to claim 24 and comprising:
a. said second means comprising a bracket connecting with one of said members;
b. a clamping device connecting with said bracket;
c. said clamping device and said bracket moveable with respect to each other; and,
d. when said members are juxtapositioned to each other on said first cant and are, substantially, parallel said clamping device moving to a position to maintain said members juxtapositioned to each other on said first cant and, substantially, parallel to each other on said first cant.

27. A combination of a gripping device, an adapter bracket and a first cant according to claim 24 and comprising:
a. said first leg and said second leg of said U-shaped positioning structure being spaced apart from the first member and the second member so as to receive and support a first object and a second object;
b. a third means on one of said members and directed toward the other member, when said members are facing each other, for making an indentation into said first cant between said members and to assist in holding said gripping device in position on said first cant.

28. A combination of a gripping device, an adapter bracket and a first cant according to claim 24 and comprising:
a. a recess in said base; and,
b. a passageway in at least one of said legs.

29. A combination of gripping device an adapter bracket and a first cant according to claim 24 and comprising:
a. said support structure being of a U-configuration and having a base, a first leg and a second leg;
b. the base of said adapter bracket and the base of said support structure being connected; and,
c. the legs of said adapter bracket and the legs of said support structure being, substantially, at right angles.

30. A combination of a gripping device, an adapter bracket and a first cant according to claim 24 and comprising:
a. said combination comprising a first said gripping device on a first cant and a second said gripping device, spaced apart from said first said gripping device, on another first cant;
b. an adapter bracket positioned on each of said gripping devices; and,
c. a second cant extending between and supported on each adapter bracket positioned on each of said gripping devices.

31. A combination of a gripping device, an adapter bracket and a first cant according to claim 30 and comprising:
a. a combination of a third said gripping device and adapter bracket on another first cant and a combination of a fourth said gripping device and adapter bracket on another first cant;
b. another second cant extending between and on the adapter bracket on said third gripping device and the adapter bracket on said fourth gripping device; and,
c. a cant extending between and supported on said second cants.

32. A first combination of a first gripping device, a first utility bracket and a first cant:

A. said gripping device comprising:

I. a first member and a second member;

II. a first means uniting said first member and said second member;

III. said first member and said second member being capable of moving with respect to each other;

IV. when said first member and said second member are, substantially, parallel a second means, operatively, connecting with one of said members to hold in a fixed position said first member and said second member;

B. said utility bracket comprising:

VI. a horizontal support arm;

VII. a vertical leg brace;

VIII. a diagonal leg brace;

IX. said horizontal support arm operatively connecting with said vertical leg brace and said diagonal leg brace;

X. said vertical leg brace operatively connecting with said diagonal leg brace;

XI. a brace on the lower part of said vertical leg brace for connecting with an object;

XII. a means juxtapositioned to the upper part of said vertical leg brace for connecting to an object;

XIII. a hanging bracket on the inner end of said horizontal support arm;

C. said hanging bracket, operatively, connects with said second means to support said utility bracket on said gripping device;

D. a third means on one of said members and directed toward the other member, when said members are facing each other, for making an indentation into said first cant between said members and to assist in holding said gripping device in position on said first cant; and, E. said brace on the lower of said vertical leg having two spaced apart outwardly directed arms for connecting with said first cant with each of said outwardly directed arms juxtapositioned to a side of said cant.

33. A first combination of a first gripping device, a first utility bracket and a first cant according to claim 32 and comprising:

a. a second combination of a second gripping device, a second utility bracket and another first cant;

b. said first combination and said second combination being spaced apart; and, c. a second cant supported on the horizontal support arm of said first combination and on the horizontal support of said second combination and extending between said first combination and said second combination.

34. A first combination of a first gripping device, a first utility bracket and a first cant according to claim 32 and comprising:

a. said members being capable of moving in a, substantially, complete circle;

b. said members facing each other except when said members define a substantially straight member;

c. a pivot means connecting together said horizontal support arm and said diagonal leg brace;

d. said horizontal support arm and said diagonal leg brace being capable of moving with respect to each other;

e. a pivot means connecting together said horizontal support arm and said vertical leg brace; and, f. said horizontal support arm and said vertical leg brace being capable of moving with respect to each other.

35. A first combination of a first gripping device, a first utility bracket and a first cant according to claim 42 and comprising:

a. said second means comprising a bracket connecting with one of said members;

b. a clamping device connecting with said bracket;

c. said clamping device and said bracket moveable with respect to each other;

d. when said members are juxtapositioned to each other and are, substantially, parallel said clamping device moving to a position to maintain said members juxtapositioned to each other, and, substantially, parallel to each other;

e. said horizontal support arm comprising a member offset from said vertical leg brace and said diagonal leg brace;

f. said vertical leg brace being capable of rotating to lie alongside said member to assist in making said utility bracket compact; and, g. said diagonal leg brace being capable of rotating to be alongside said member to assist in making said utility bracket compact.

36. A first combination of a first gripping device, a first utility bracket and a first cant according to claim 35 and comprising:

a. said bracket comprising a first leg connecting with one of said members and a second leg;

b. said second leg being at an angle to said first leg;

c. said second leg being spaced apart from the member to which the bracket is attached so that said bracket can receive an object;

d. a stub support positioned on said vertical leg brace and juxtapositioned to the lower end of said vertical leg brace; and, e. with said utility bracket in an operating state said stub support being directed toward the first pivot means connecting together said horizontal support arm and said diagonal leg brace and the free end of said diagonal leg brace operatively connecting with said support stub to position said diagonal leg brace on said support stub.

37. A first combination of a first gripping device, a first utility bracket and a first cant according to claim 36 and comprising:

a. said clamping device comprising a U-clamp having a base, a first leg and a second leg;

b. when said U-clamp is positioned to maintain said members juxtapositioned to each other the first leg of said clamp is on the outside of one of said members and the second leg is on the outside of the other one of said members;

c. said horizontal support arm comprising two spaced apart members;

d. a hanging bracket connecting with said two spaced apart members;

e. said hanging bracket being positioned on that end of the horizontal support arm near the pivot means between the horizontal support arm and said vertical leg brace and on that side of said horizontal support arm away from said vertical leg brace;

f. said vertical leg brace being capable of rotating to lie partially between said two members to assist in making said utility bracket compact; and, g. said diagonal leg brace being capable of rotating to lie partially between said two members to assist in making said utility bracket compact.

* * * * *